US007477228B2

(12) United States Patent
Wyatt

(10) Patent No.: US 7,477,228 B2
(45) Date of Patent: Jan. 13, 2009

(54) METHOD AND APPARATUS FOR CHARACTERIZING AND/OR PREDICTING DISPLAY BACKLIGHT RESPONSE LATENCY

(75) Inventor: David A. Wyatt, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 722 days.

(21) Appl. No.: 10/745,239

(22) Filed: Dec. 22, 2003

(65) Prior Publication Data

US 2005/0134547 A1 Jun. 23, 2005

(51) Int. Cl.
*G09G 3/36* (2006.01)

(52) U.S. Cl. ..... 345/102; 345/99

(58) Field of Classification Search ..... 345/87–89, 345/97, 94, 99, 102

See application file for complete search history.

(56) References Cited

U.S. PATENT DOCUMENTS

| | | | | |
|---|---|---|---|---|
| 5,488,434 | A | 1/1996 | Jung | |
| 5,532,719 | A | 7/1996 | Kikinis | |
| 5,854,617 | A | 12/1998 | Lee et al. | |
| 5,915,120 | A * | 6/1999 | Wada et al. | 713/310 |
| 6,111,559 | A | 8/2000 | Motomura et al. | |
| 6,346,937 | B1 | 2/2002 | Sasaki et al. | |
| 6,388,388 | B1 | 5/2002 | Weindorf et al. | |
| 6,466,196 | B1 | 10/2002 | Isogawa et al. | |
| 6,611,249 | B1 | 8/2003 | Evanicky et al. | |
| 6,724,360 | B2 * | 4/2004 | Kondoh | 345/97 |
| 6,750,837 | B1 * | 6/2004 | Kondoh | 345/97 |
| 6,952,195 | B2 * | 10/2005 | Arakawa | 345/102 |
| 7,119,786 | B2 * | 10/2006 | Cui | 345/102 |
| 7,136,044 | B2 * | 11/2006 | Sasaki | 345/102 |
| 2001/0022584 | A1 | 9/2001 | Tsugawa | |
| 2002/0003522 | A1 | 1/2002 | Baba et al. | |
| 2002/0158831 | A1 * | 10/2002 | Kondoh | 345/97 |
| 2005/0104838 | A1 * | 5/2005 | Sasaki | 345/102 |
| 2006/0001641 | A1 * | 1/2006 | Degwekar et al. | 345/102 |

FOREIGN PATENT DOCUMENTS

| | | | |
|---|---|---|---|
| EP | 0 883 103 | A1 | 12/1998 |
| EP | 0 888 004 | A2 | 12/1998 |
| EP | 1 111 575 | A1 | 6/2001 |
| JP | 11 213090 | A | 8/1999 |
| JP | 2000330542 | A | 11/2000 |

OTHER PUBLICATIONS

PCT International Search Report for PCT International Application No. US02/18738, mailed Dec. 5, 2002 (5 pages).
PCT Invitation to Pay Additional Fees for PCT International Application No. US2004/000249, mailed Jun.7, 2004 (3 pages).

* cited by examiner

*Primary Examiner*—Ricardo L Osorio
(74) *Attorney, Agent, or Firm*—Kacvinsky LLC

(57) ABSTRACT

An approach to controlling an electronic system display includes determining a latency associated with changing a backlight brightness from a first level to a second level, and based on the determined latency, providing the latency predictions to a coordinating entity, which adjusts the backlight brightness and image luminance to occur in such a manner so as to substantially avoid associated visually disturbing artifacts which would otherwise occur if the two actions were applied asynchronously.

21 Claims, 10 Drawing Sheets

METHOD AND APPARATUS FOR CHARACTERIZING AND/OR PREDICTING DISPLAY BACKLIGHT RESPONSE LATENCY

CROSS REFERENCE TO RELATED APPLICATIONS

This application is related to the following co-pending U.S. patent applications: 1) U.S. patent application Ser. No. 10/663,316 entitled, "Automatic Image Luminance Control with Backlight Adjustment", assigned to the assignee of the present invention and filed Sep. 15, 2003; 2) U.S. patent application Ser. No. 09/896,341 entitled "Method and Apparatus for Enabling Power Management of a Flat Panel Display," assigned to the assignee of the present invention and filed Jun. 28, 2001; 3) U.S. patent application Ser. No. 10/367,070 entitled "Real-Time Dynamic Design of Liquid Crystal Display (LCD) Panel Power Management Through Brightness Control," assigned to the assignee of the present invention and filed Feb. 14, 2003; and 4) U.S. patent application Ser. No. 10/882,446 entitled "Method and Apparatus to Synchronize Backlight Intensity Changes with Image Luminance Changes," assigned to the assignee of the present application and filed Jun. 30, 2004.

BACKGROUND

An embodiment of the present invention relates to the field of display backlight control and, more particularly, to characterizing and/or predicting display backlight response latency.

Computing devices that can be easily moved from place to place often include an alternative power source, such as a battery, to facilitate mobility. Examples of such devices include laptop or notebook computers, personal digital assistants (PDAs), wireless phones, etc.

Where a battery or another limited power source is used, it is typically desirable to provide for efficient power usage to enable a longer operating period. Various measures may be taken to extend battery life, such as, for example, shutting down components that are not in use.

In many computing devices the display is responsible for a relatively large percentage of overall power consumption. In laptop computers, for example, the display may account for 30% of the power consumed. In order to reduce display power consumption, some computing systems may reduce the panel backlighting when the system is being powered by a battery instead of an AC power source. Reducing the panel backlighting may be perceived as a reduction in display quality, particularly in brighter ambient environments.

BRIEF DESCRIPTION OF THE DRAWINGS

The present invention is illustrated by way of example and not limitation in the figures of the accompanying drawings in which like references indicate similar elements, and in which.

DETAILED DESCRIPTION

Methods and apparatuses for characterizing and/or predicting display backlight response latency are described. In the following description, particular software modules, components, systems, etc. are described for purposes of illustration. It will be appreciated, however, that other embodiments are applicable to other types of software modules, components, and/or systems, for example.

References to "one embodiment," "an embodiment," "example embodiment," "various embodiments," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

Placement-related terms in the description that follows such as, for example, above, below, behind, etc. may be used to indicate relative placement in the context of the figures as shown. It will be appreciated that different orientations of the various components of the invention may result in a different relative placement of components to each other.

For one embodiment, an electronic system, such as the computing system of FIG. 2, may provide for dynamic adjustment of both display backlight and image contrast/brightness/gamma (or luminance) in a coordinated manner. The dynamic adjustments to display backlight and image luminance according to some embodiments may be coordinated such that the end-user visual experience is not significantly impacted and/or visual artifacts that may be caused by a lack of such coordination are substantially avoided. Further details of these and other embodiments are provided in the description that follows.

Figure 1:
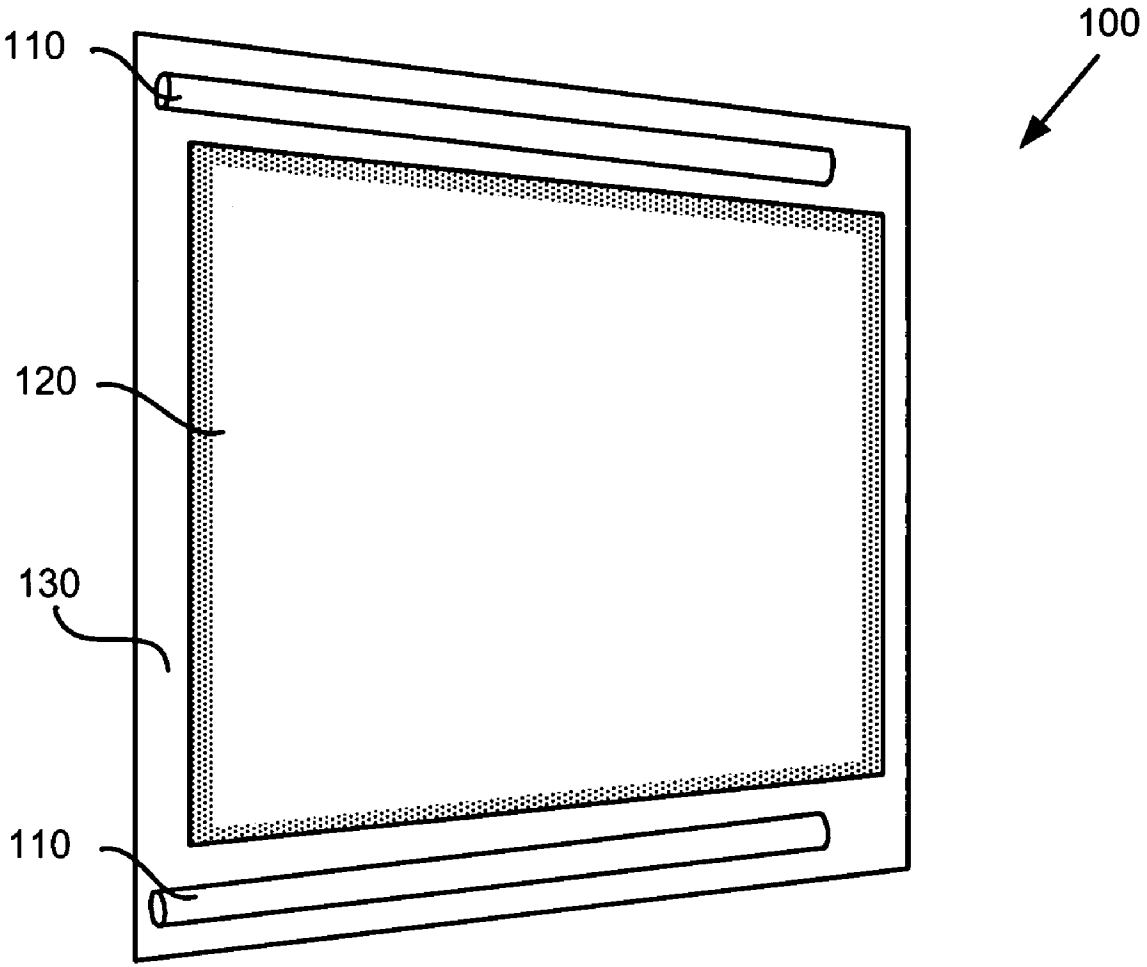
FIG. 1 is an isometric view of a panel display that may be used for some embodiments.

FIG. 1 shows an isometric view of a panel display 100 that may be used for one embodiment. The panel display 100 may include one or more backlights 110, a panel 120, and a light spreader 130. The backlight(s) 110 may include, for example, a cold cathode fluorescent tube. For other embodiments, the backlight(s) 110 may include one or more Electroluminescence Panels (ELP) or Incandescent Lamps, or light emitting diodes (LEDs), such as, for example, white LEDs, which may be driven in a conventional manner. The backlight(s) may be located behind and above/below the panel 120 to provide illumination to the rear of the panel 120.

The panel 120 may include, for example, a liquid crystal display (LCD) panel that is arranged to display an image that is illuminated by the backlight(s) 110. Other types of backlit display technologies may also be used for various embodiments.

The light spreader 130 may be arranged substantially behind the backlight(s) 110, and may also extend above/below the backlight(s) 110 to direct their light to the rear of the panel 120. The light spreader may reflect and/or diffuse light from the backlight(s) 110 to illuminate the panel 120 substantially uniformly along its surface. Other embodiments, using, for example white LEDs, may not use a light spreader, or may be incorporated within a light box, or use an encapsulated lens for directing radiated light energy.

Figure 2A:
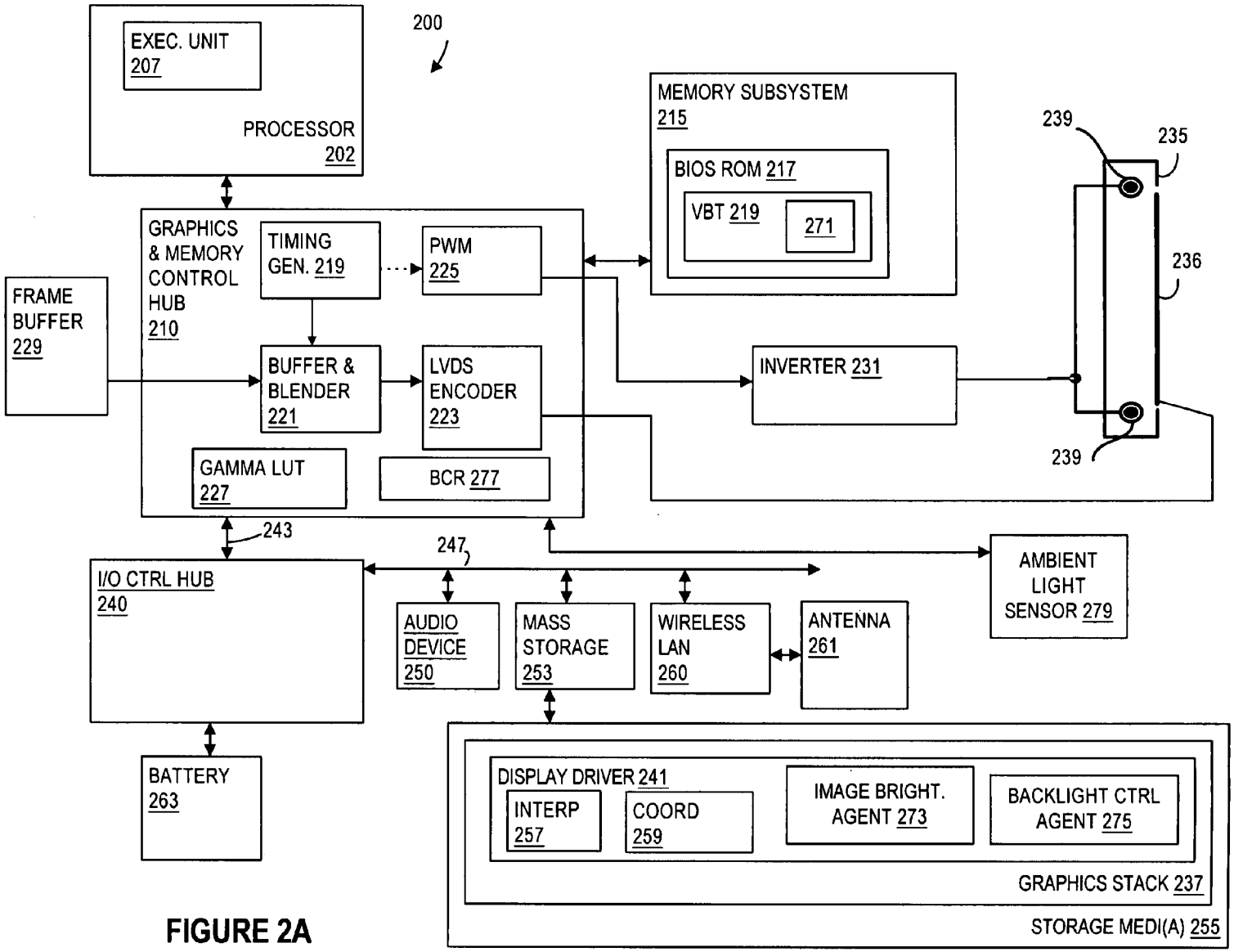
FIGS. 2A and 2B are block diagrams of exemplary computing systems in which the approaches of one or more embodiments for characterizing and/or predicting display backlight response latency and/or coordinating dynamic adjustments to backlight and image luminance may be advantageously implemented.

FIG. 2A is a block diagram of an exemplary computing system 200 that may advantageously implement the approaches of one or more embodiments for coordinating backlight brightness and image luminance adjustments. While the example system of FIG. 2A is a laptop computer system, it will be appreciated that the image adaptation techniques described herein may be applied to many different types of systems with an associated display device. Examples of such systems include, but are not limited to, personal digital assistants (PDAs), palm top computers, notebook computers, tablet computers, desktop computers using flat panel displays, wireless phones, kiosk displays, etc.

The computing system 200 includes a processor 202 coupled to a bus 205. The processor 202 includes an execution unit 207 to execute instructions that may be stored in one or more storage devices in the system 200 or that are otherwise accessible by the system 200.

For one embodiment, the processor 202 may be a processor from the Pentium® family of processors such as, for example, a processor from the Pentium-M family of processors available from Intel Corporation of Santa Clara, Calif. Alternatively, a different type of processor and/or a processor from a different source and/or using a different architecture may be used instead or in addition to the above-described processor. Other types of processors that may be used for various embodiments include, for example, a digital signal processor, an embedded processor or a graphics processor.

A graphics and memory control hub (or GMCH) 210 is also coupled to the bus 205. The graphics and memory control hub 210 may include a memory controller (not shown) that is coupled to a memory subsystem 215. The memory subsystem 215 is provided to store data and instructions to be executed by the processor 202 or any other device included within the electronic system 200. For one embodiment, the memory subsystem 215 may include dynamic random access memory (DRAM). The memory subsystem 215 may, however, be implemented using other types of memory in addition to or in place of DRAM. For some embodiments, the memory subsystem 215 also includes BIOS (Basic Input/Output System) ROM 217 including a Video BIOS Table (VBT) 219. Additional and/or different devices not shown in FIG. 2 may also be included within the memory subsystem 215.

Also coupled to the graphics and memory control hub 210 over a bus 243 is an input/output (I/O) control hub 245 or other type of I/O controller, which provides an interface to input/output devices. The input/output controller 245 may be coupled to, for example, a Peripheral Component Interconnect (PCI™) or PCI Express™ bus 247 adhering to a PCI Specification such as Revision 2.1 (PCI) or 1.0a (PCI Express) promulgated by the PCI Special Interest Group of Portland, Oreg. For other embodiments one or more different types of buses such as, for example, an Accelerated Graphics Port (AGP) bus according to the AGP Specification, Revision 3.0 or another version, may additionally or alternatively be coupled to the input/output controller 245 or the bus 247 may be a different type of bus.

Coupled to the input/output bus 247 for one embodiment are an audio device 250 and a mass storage device 253, such as, for example, a disk drive, a compact disc (CD) drive, and/or a network device to enable the electronic system 200 to access a mass storage device over a network. An associated storage medium or media 255 is coupled to the mass storage device 253 to provide for storage of software and/or other information to be accessed by the system 200.

In addition to an operating system (not shown) and other system and/or application software, for example, the storage medium 255 may store a graphics stack 237 to provide graphics capabilities as described in more detail below. A display driver 241 may be included in the graphics stack 237. For one embodiment, the display driver 241 includes or works in cooperation with at least an interpolation module 257 and a coordination module 259 described in more detail below. Other modules may also be included for other embodiments.

The system 200 may also include a wireless local area network (LAN) module 260 and/or an antenna 261 to provide for wireless communications. A battery or other alternative power source adapter 263 may also be provided to enable the system 200 to be powered other than by a conventional alternating current (AC) power source.

Figure 2B:
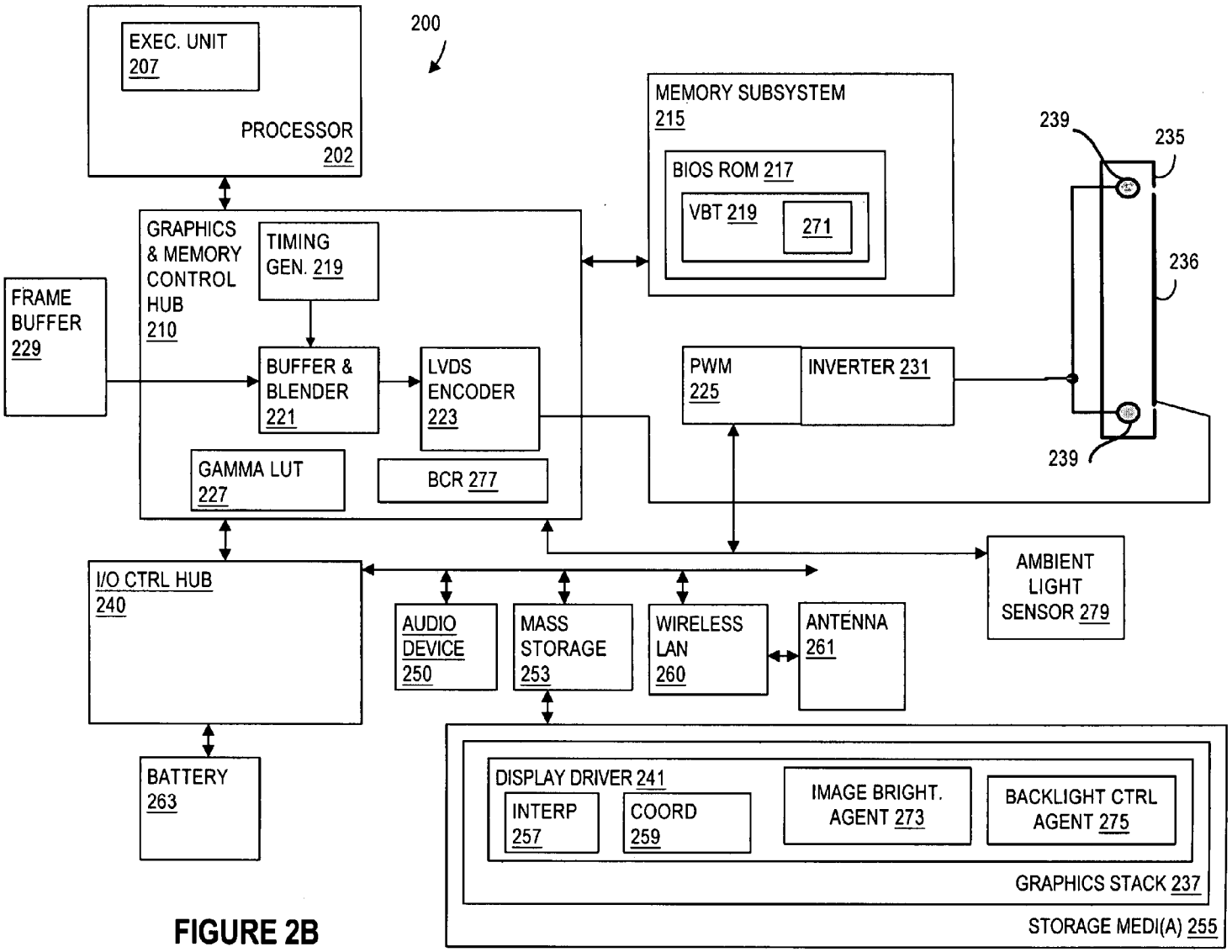

With continuing reference to FIG. 2A, the graphics and memory control hub 210 may further include graphics control capabilities. As part of the graphics control capabilities, a timing generator 219, a buffer and blender 221, an encoder 223, a gamma look-up table (LUT) 227 or other mechanisms through which adjustments of image luminance may be provided. Also associated with LCD display brightness are a pulse width modulator (PWM) 225, a high voltage inverter 231, and a cold cathode fluorescent lamp (CCFL) backlight 239 however other embodiments may include alternate methods for providing backlight, including but not limited to, Electroluminescence Panel (ELP), Incandescent Light, or Light Emitting Diode (LED). Also some embodiments may not require a PWM or high-voltage inverter such as in Incandescent Light backlighting using direct drive DC current, or may include PWM and no inverter such as in LED backlighting. Also associated with graphics control capabilities are a frame buffer 229, and a display 235, which may be implemented in a similar manner to the display 100 of FIG. 1 including a panel 236, the graphics stack 237 including the display driver 241 and other modules described below. In various implementations, two or more of elements discussed above may be integrated within a single device or in a different manner for other embodiments. For example, as shown in FIG. 2B, the pulse width modulator 225 may be integrated with the graphics controller, in a standalone component or integrated with the inverter 231. For such embodiments, the PWM 225/inverter 231 may be driven by software and coupled to either the graphics and memory control hub 210 or the I/O control hub 240. Further, the functionality of one or more of the graphics-related elements may be implemented in hardware, software, or some combination of hardware and software.

The frame buffer 229, timing generator 219, buffer and blender 221, and encoder 223 may cooperate to drive the panel 236 of the panel display 235. The frame buffer 229 may include a memory (not shown) and may be arranged to store one or more frames of graphics data to be displayed by the panel display 235.

The timing generator 219 may be arranged to generate a refresh signal to control the refresh rate (e.g. frequency of refresh) of the panel 236. The timing generator 219 may produce the refresh signal in response to a control signal from the display driver 241. In some implementations, the refresh signal produced by the timing generator 219 may cause the panel 236 to be refreshed at a reference refresh rate (e.g. 60 Hz) during typical (e.g. non-power saving) operation. During power saving operation, the timing generator 219 may lower refresh rates for panel display 110 (e.g. to 50 Hz, 40 Hz, 30 Hz, etc.). Associated with the refresh rate is a vertical blanking interval (VBI).

The buffer and blender 221 may read graphics data (e.g. pixels) from the frame buffer 229 in graphics memory at the refresh rate specified by the refresh signal from the timing generator 219. The buffer and blender 221 may blend this graphics data (e.g. display planes, sprites, cursor and overlay) and may also gamma correct the graphic data. The buffer and blender 221 also may output the blended display data at the refresh rate. In one implementation, the buffer and blender 221 may include a first-in first-out (FIFO) buffer to store the graphics data before transmission to the encoder 223.

The encoder 223 may encode the graphics data output by the buffer and blender 221 for display on the panel 236. Where the panel 236 is an analog display, the encoder 223 may use a low voltage differential signaling (LVDS) scheme to drive the panel 236. For other implementations, if the panel 236 is a digital display, the encoder 223 may use another encoding scheme that is suitable for this type of display. Because the encoder 223 may receive data at the rate output by the buffer and blender 221, the encoder may refresh the panel 236 at the refresh rate specified by the refresh signal from the timing generator 219.

The PWM 225 and inverter 231 may cooperate to drive the backlight(s) 239 in the panel 235. The PWM may be arranged to output a PWM signal that has a modulation frequency and a duty cycle. For some implementations, the duty cycle setting of the PWM 225 may be varied by the display driver 241, or in another manner, to dim the light output by the backlight(s) 239. The PWM 225 may be arranged to output the PWM signal to the inverter 231 at a reference modulation frequency and duty cycle during typical (e.g. non-power saving) operation.

For one implementation, the PWM 225 may receive a timing signal from the timing generator 219 and may derive its base frequency from this timing signal, upon which the output duty cycle is modulated according to a PWM interface setting value. Such an implementation is illustrated by the dashed line between the timing generator 219 and the PWM 225. For other implementations, however, the PWM 225 may include its own, separate timing generator for use in deriving its reference clock. In either case, the modulation frequency of PWM 225 may be adjusted (e.g. lowered during a power saving mode) by the display driver 241 or another module.

The inverter 231 may be arranged to receive the PWM signal at the modulation frequency from the PWM 225 and to drive the backlight(s) 239 based on the modulation frequency of the PWM signal. The inverter 231 may produce an output whose "backlight frequency" is a multiple of the modulation frequency of the received PWM signal from the PWM 225. For one implementation, the backlight frequency of the output of the inverter 231 may be substantially the same frequency as the PWM signal. For other implementations, the inverter 231 may be arranged to effect a higher multiple of the modulation frequency, producing an output signal with a backlight frequency that may vary over a larger range.

For one embodiment the gamma LUT 227 may be provided to adjust the sub-pixel colors prior to being sent to the display device. In an alternate embodiment a separate luminance adjustment stage (e.g. using HSI or YUV color-space conversion and adjustment) may be included prior to or after gamma LUT. As such, color luminance or contrast may be adjusted via modification of the color look-up table (gamma LUT) 227 or through a discrete luminance adjustment stage.

Figure 3:
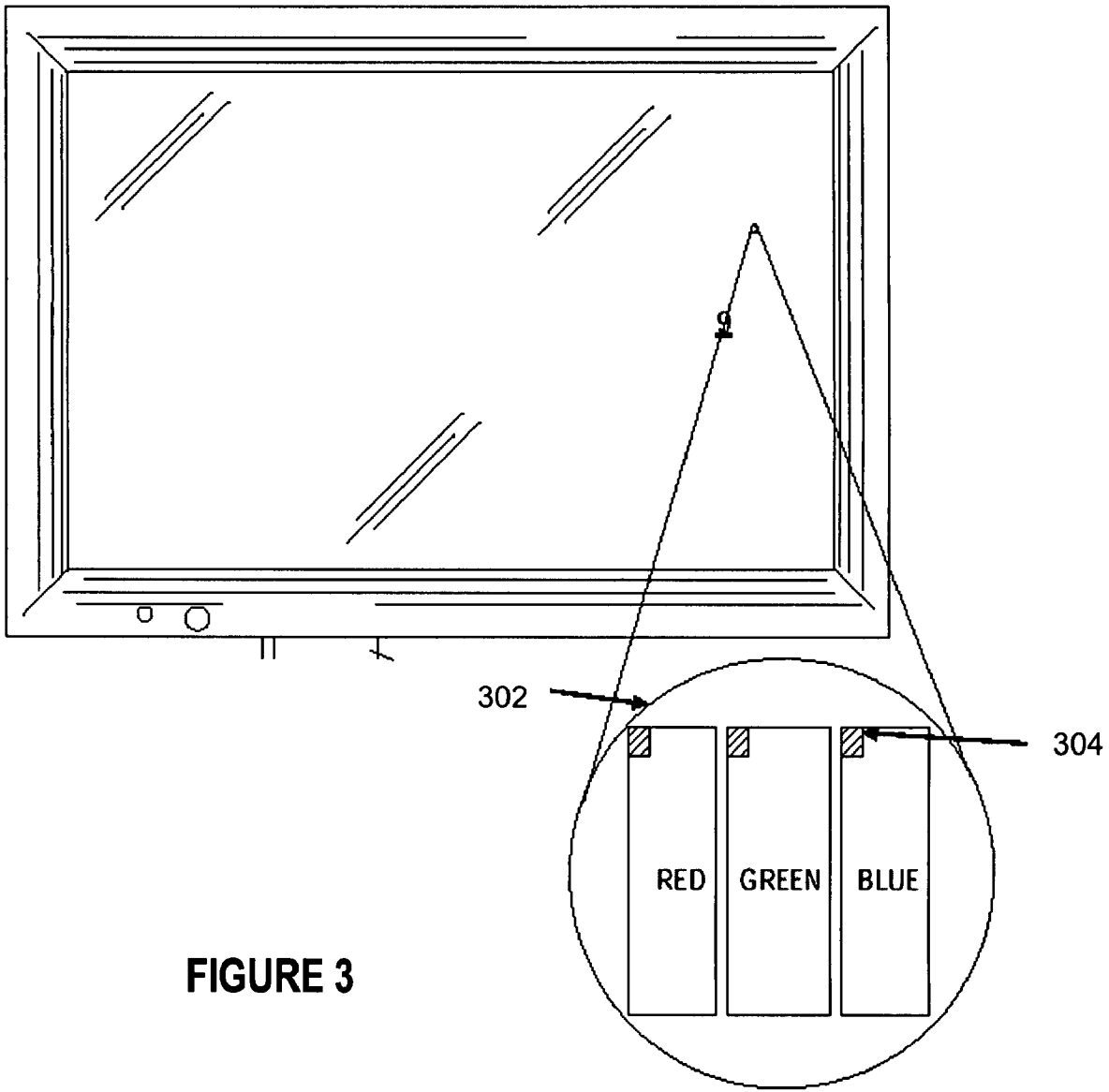
FIG. 3 is an illustration of a display and an associated group of pixels for one embodiment.

FIG. 3 illustrates a group of pixels within a flat-panel monitor screen such as the display 100 of FIG. 1. For one embodiment, the pixels are formed using thin film transistor (TFT) technology, and each pixel is composed of three sub-pixels that, when enabled, cause a red, green and blue (RGB) color to be displayed. Each sub-pixel is controlled by a TFT (e.g. 304). A TFT enables light from the display backlight to pass through a sub-pixel, thereby illuminating the sub-pixel to a particular color. Each sub-pixel color may vary according to a combination of bits representing the sub-pixel. The number of bits representing a sub-pixel determines the number of colors, or color depth, that may be displayed by a sub-pixel. Sub-pixel coloring is known in the art and any appropriate technique for providing sub-pixel coloring, including those according to a different color-coding scheme, may be used.

A brighter or dimmer luminance of color (effecting different levels of image contrast) being displayed by a pixel may be achieved by scaling the value representing each sub-pixel color within the pixel. The particular values used to represent different colors depend upon the color-coding scheme, or color space, used by the particular display device. By modifying color luminance of the sub-pixels (by scaling the values representing sub-pixel colors), the perceived brightness of the display image may be modified on a pixel-by-pixel basis.

It will be appreciated that systems according to various embodiments may not include all the elements described in reference to FIGS. 2A and/or 2B and/or may include elements not shown in FIG. 2A or 2B. For example, for some embodiments, an ambient light sensor (ALS) 279 and associated circuitry and/or software may be included to assist in determining when to adjust backlight brightness and/or display contrast. The ALS 279 may be coupled to, for example, a graphics bus or a system management bus coupled to the graphics and memory control hub 210. For some embodiments, the ALS 279 does not directly control backlight adjustments, but rather readings from the ALS 279 may be used with a backlight control algorithm to effect changes to the backlight.

For one embodiment, as mentioned above, the brightness of the backlight(s) 239 may be dynamically adjusted to provide for more efficient power usage, to adjust brightness according to ambient conditions and/or to compensate for image intensity changes. Color intensity values for the pixels may also be dynamically adjusted to change display contrast based on ambient conditions and/or backlight intensity. By adjusting the backlight and contrast together, it may be possible for some embodiments, to improve power efficiency while still providing a substantially similar perceived display brightness as discussed in detail in the copending patent application referenced at the beginning of the present application.

Issues may arise, however, if the adjustments to the backlight and image luminance are not coordinated properly as discussed above. For example, a portion of an image may be displayed with one brightness and contrast level while the brightness or contrast level of another portion of the image may be different.

More particularly, while changes to the gamma LUT 227 and resultant changes to the image luminance are effectively instantaneous (e.g. the new gamma-range color/luminance/contrasts may take effect immediately, on the next vertical scanline, or on the next vertical frame after the change is made), adjustment of backlight brightness is not typically immediate. Apart from the communication overhead through the PWM 225 and inverter 231, for example, the PWM 225 takes at least an additional pulse in order to reach a new duty-cycle associated with a target backlight brightness, and the inverter 231 may take several pulses to stabilize at a new setting. Further, where fluorescent illumination is used, for example, there may be a latency of hundreds to thousands of milliseconds for some exemplary backlights to reach a target perceptual brightness level (e.g. due to the time it takes gas-electric discharge to cause the fluorescent lining of the lamp to illuminate to the target level).

Figure 4:
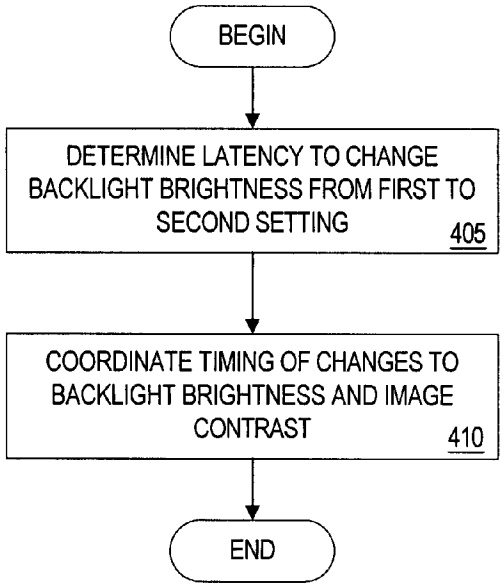
FIG. 4 is a flow diagram showing a method of one embodiment for adjusting characteristics of a display.

To substantially avoid associated visually disturbing artifacts, for one embodiment, as shown in the flow diagram of FIG. 4, changes to the backlight brightness and gamma table (resulting in a change in image luminance) are coordinated to occur close in time to each other and substantially aligned with the vertical blanking interval.

At block 405, in order to coordinate changes to the backlight brightness with changes to the image luminance, the latency associated with changing the backlight from a first brightness level to a second, target brightness level is determined and at block 410, changes to the backlight brightness and image luminance are coordinated such that they substantially avoid causing associated visually disturbing artifacts.

Determining the backlight latency may not necessarily be straightforward due to the fact that the latency may be affected by many factors. Such factors may include, for example, choice of backlight technology, the fluorescence of a particular backlight provider's backlight tube or response time of white LEDs, characteristics of the inverter circuit charge pump that drives the CCFL backlight, the base frequency of the PWM, and characteristics of the panel in front of the backlight, and the image being displayed on the panel.

With this in mind backlight response may be characterized for a particular electronic system for which it is desirable to implement the coordinated image adjustment approach of one or more embodiments. To characterize the latency associated with changing the backlight brightness, for one embodiment, a test measurement setup such as the arrangement 500 shown in FIG. 5 may be used for example.

Figure 5:
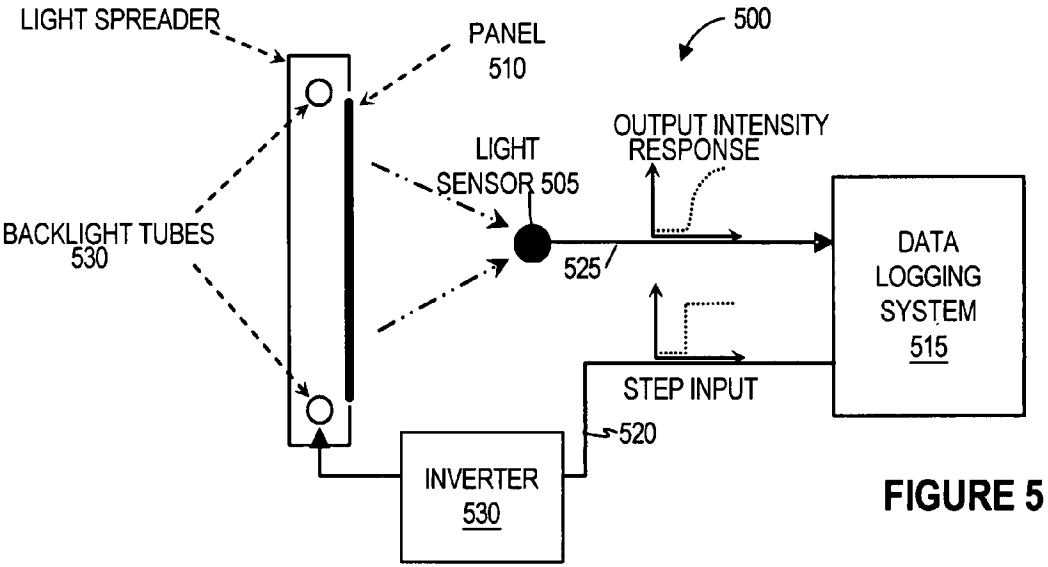
FIG. 5 is a diagram showing an exemplary system for one embodiment that may be used to characterize and log backlight response latency.

In the test setup 500 of FIG. 5, a light sensor 505 is placed opposite a panel 510 for which the backlight latency is to be characterized. The light sensor 505 may be any available light sensor that is capable of measuring backlight brightness as described herein. For one embodiment, the light sensor 505 may be separated from the panel 510 during the characterization by the average viewer distance (i.e. the average distance between the eyes of a viewer and the display). For other embodiments, a different distance between the panel 510 and the light sensor 505 may be used. The test setup 500 may also include a data logging system 515 that provides an input signal over a signal line 520 and captures a responsive signal from the light sensor via a signal line 525.

Figure 6:
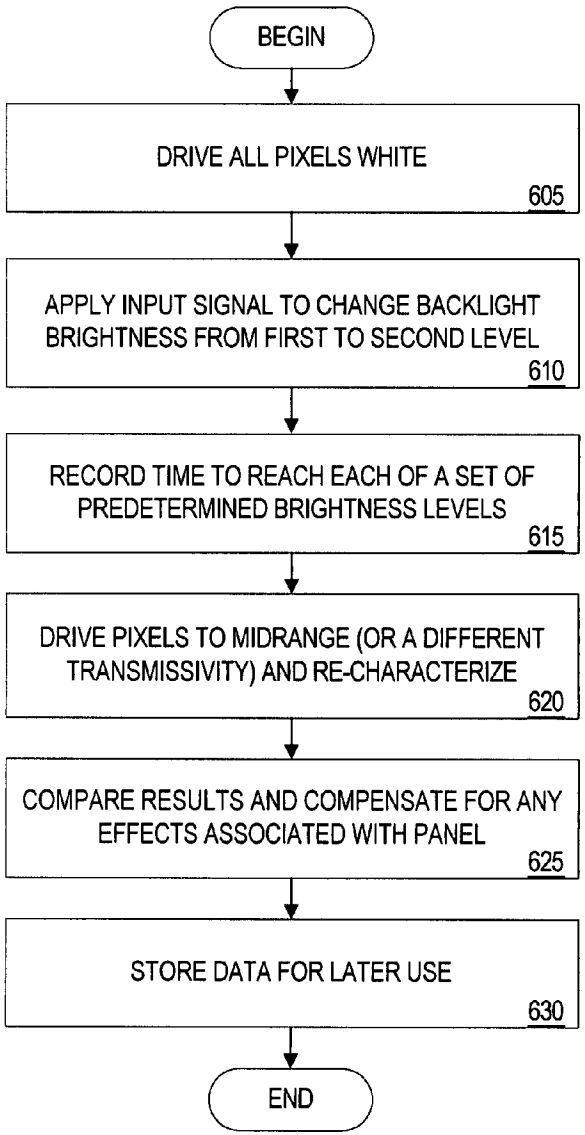
FIG. 6 is a flow diagram showing a method of one embodiment for characterizing backlight latency.

In operation, for one embodiment, referring to FIGS. 5 and 6, the pixels of the panel 510 are driven all white at block 605. For a transmissive display such as a liquid crystal display (LCD), driving the pixels all white allows for high transmission of the backlight. Other elements that may affect the backlight response may also be set to a predetermined setting (e.g. maximum duty cycle, a given inverter frequency, etc.) The data logging system 515 may then apply a step input function to an inverter 530 that drives the backlight(s) 535 to change the backlight(s) 535 from a first brightness to a second brightness at block 610. The data logging system 515 then records the time it takes to reach each of a set of predetermined target brightness levels at block 615.

For example, the step input signal provided over the signal line 520 may transition from a first voltage level to a second voltage level, where the first voltage level causes the backlight brightness to be substantially 0% of the achievable backlight brightness and the second voltage level is high enough to cause the backlight brightness to reach substantially 100% of the achievable backlight brightness. The data logging system 515 may then record the latency associated with achieving each of a predetermined set of brightness levels, e.g. 10% at T1, 20% at T2, 40% at T3, 60% at T4, 80% at T5, 90% at T6 and 100% at T7. Latencies associated with other target brightness levels and/or a different number of latencies may be measured for other embodiments.

For one embodiment, the backlight latency may then be characterized again in a similar manner at block 620, but with the pixels all driven to their midrange transmissivity (e.g. gray). The results of this characterization may then be compared to results of the characterization with the pixels driven all white to eliminate any effects associated with the panel at block 625. This second characterization may not be performed for some embodiments.

The resulting characterization data may then be stored in a storage area of the associated electronic system for later retrieval and use at block 630. Where the electronic system is similar to the electronic system 200 of FIG. 2A or 2B, for example, the captured data 271 may be stored in a platform customization storage area such as the VBT 219. In this manner, the backlight latency data remains with the system with which it is associated. For other implementations in accordance with various embodiments, the backlight latency data may be stored in another data store of the electronic system of interest or may be accessible in another manner.

For other embodiments, data indicating backlight latency may be obtained in a different manner. For example, a computing system manufacturer may obtain similar data from suppliers and then store the data as described above. Other approaches for determining backlight latencies are within the scope of various embodiments.

Once backlight responsiveness information is available to the electronic system of interest, it may be used to coordinate the timing of backlight and image luminance adjustments as mentioned above. For purposes of example, the electronic system 200 of FIG. 2A is referenced to describe the backlight latency prediction and image luminance adjustment coordination of some embodiments.

In response to a detected change in operating conditions such as, for example, a switch to an alternate power source, a change in ambient lighting, etc., and/or according to specified parameters, the display driver 241 may determine that a change in backlight brightness and/or image luminance is to be initiated and target backlight brightness and gamma LUT settings are identified. A new target perceived color brightness and image luminance of an image to be displayed may be identified based on a new target backlight brightness/intensity, or vice versa, with a goal of providing a substantially consistent viewer-perceived display quality.

The target backlight brightness and/or image luminance may be determined based on the ambient light level detected by the ambient light sensor 279, for example. In a bright environment, for example, maximum backlight intensity and/or increased color brightness may be used to provide an image that is more easily viewable. In a dimly lit room, however, decreased backlight intensity and/or color brightness may be used to provide an image that is perceived to be of substantially the same quality. As discussed above, other factors may also or alternatively be considered to determine when changes to the backlight brightness and/or image luminance are to be initiated.

A baseline brightness level that corresponds to anticipated typical usage conditions may be set by the ambient light sensor, an operating system or other software provider or a user, for example. Any changes to the brightness level may then be expressed in reference to the baseline brightness level. For some implementations, a minimum and maximum brightness level may also be defined within which the backlight is dynamically scaled in co-ordination with display image luminance control. Alternatively, changes in brightness may be expressed as percentages of the maximum brightness level, or as a percentage from the current level or in another manner.

At a high level, to effect a change in image luminance, an image brightness agent 273 may be provided with the display driver 241 or in another manner. The image brightness agent 273 adjusts the perceived color brightness and contrast of an image to be displayed by modifying the gamma LUT 227. The image brightness agent 273 may be responsive to the ambient light sensor 279 or to another sensor or control input.

To adjust the backlight brightness for one embodiment, the backlight control agent 275 writes a value representing a scaling factor to a backlight control register (BCR) 277. The value stored in the backlight control register may then be combined with one or more other parameters to determine a duty cycle for the PWM 225 to control backlight intensity.

Further details of the manner in which the backlight and/or image luminance may be adjusted for some embodiments may be provided in the above-referenced co-pending patent application.

Figure 7:
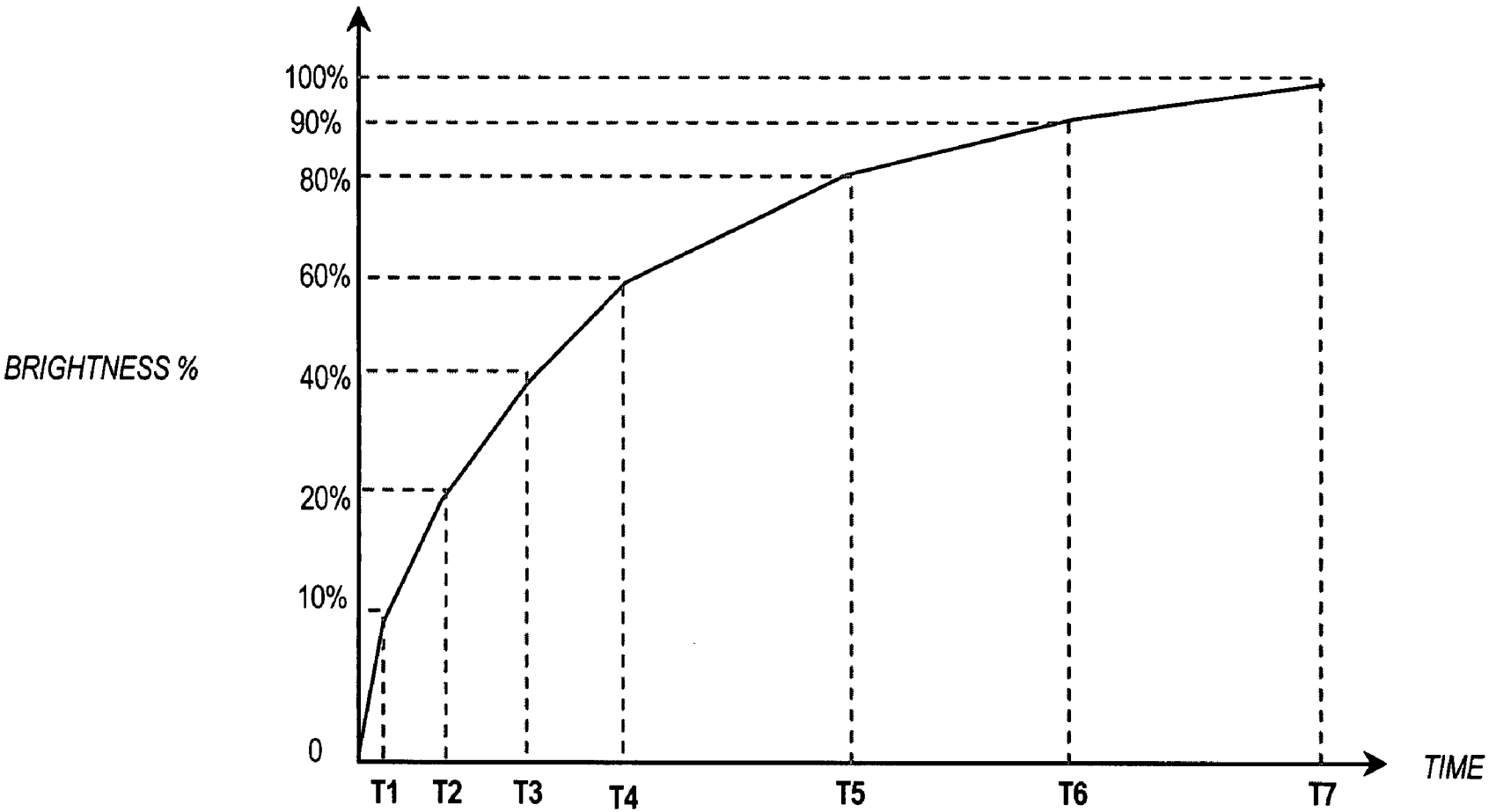
FIG. 7 is a graphical representation showing a curve representing backlight brightness vs. the time associated with changing between backlight brightness levels.

Once the target brightness level is identified, the latency associated with moving from the current brightness level to the target brightness level is determined. For one embodiment, the interpolation module 257 in the display driver 241 loads the parameters 271 stored as a result of the above-described characterization and effectively models a response curve and approximate latency involved in transitioning between current and target backlight settings as shown in FIG. 7. While the curve of FIG. 7 shows backlight transitions from 0% to 100% to demonstrate the overall non-linearity of the curve, it will be appreciated that the interpolation module 257 may only effectively model a relevant portion of the curve.

Figure 8:
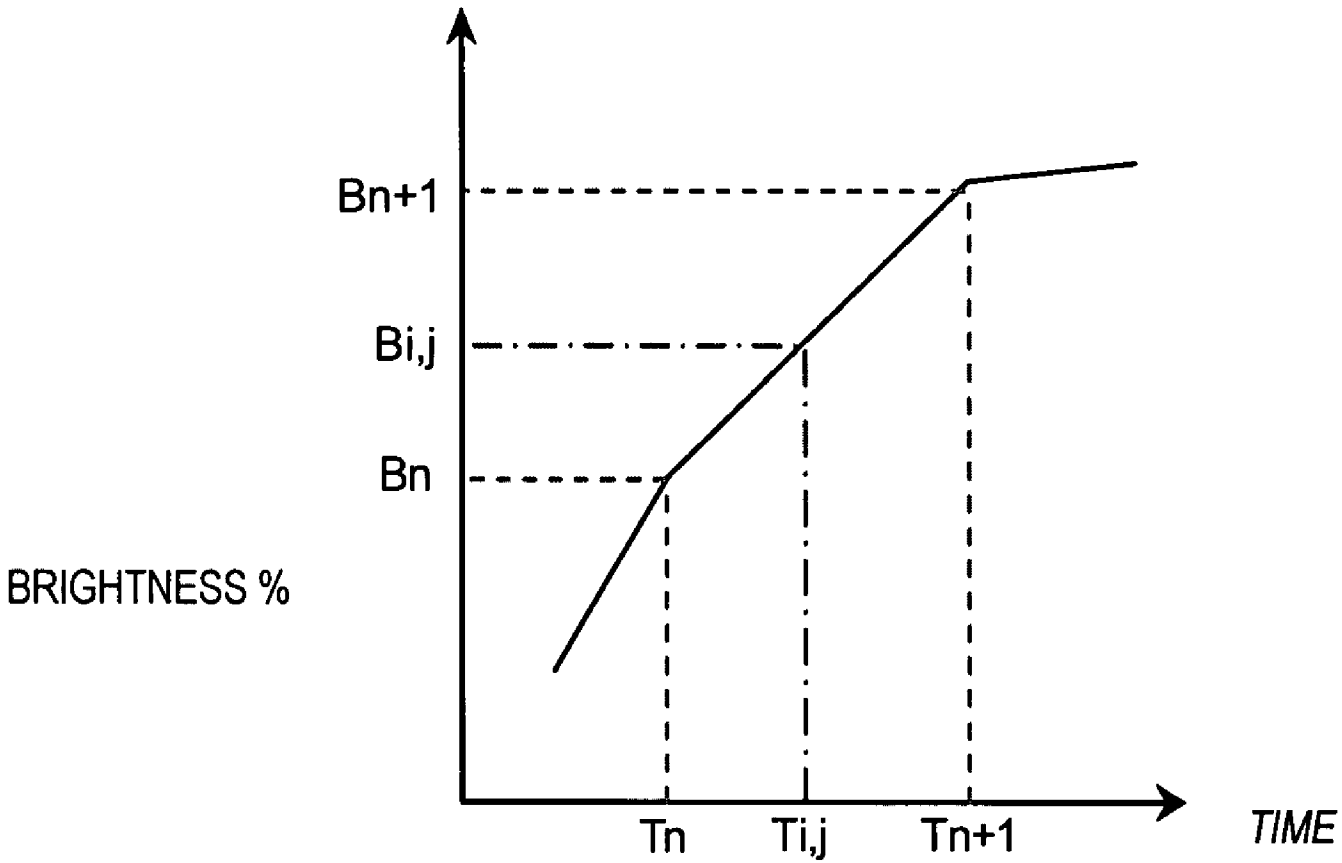
FIG. 8 is a graphical representation illustrating a piecewise approximation between various brightness and latency data points.

To model the curve, for one embodiment, a mathematical formula is applied to the stored data points 271 to interpolate the approximate latency response of the backlight in terms of the time it takes the backlight to change from a given intensity level to a goal intensity level. For example, given a current brightness level Bi and a target brightness level Bj, the objective is to find the latency to transition between Bi and Bj in time as represented by Td. Referring to the linear latency approximation curve shown in FIG. 8, Td is the delta between Tj and Ti corresponding to Bi and Bj, which can be derived using the mid-point formula on the linear sections of the piecewise approximation curve of FIG. 8. This derivation is repeated for Tj and Ti. An example of this calculation is provided below:

$$T_{i,j} = T_n + \frac{(B_{i,j} - B_n)}{(B_{n+1} - B_n)} \times (T_{n+1} - T_n)$$

where $T_n$=Floor($T_{i,j}$), the sample point: T1~T7 below $T_{i,j}$ $T_{n+1}$=Ceiling($T_{i,j}$), the sample point: T1~T7 above $T_{i,j}$ Similarly $B_n$, $B_{n+1}$ may be derived from lower, upper fixed points on the Brightness axis as illustrated in FIG. 8. Then, the latency in time Td to transition from brightness level Bi to brightness level Bj is Td=Tj−Ti. Other approaches to determining the backlight latency response are within the scope of various embodiments.

Once the latency Td associated with a particular backlight brightness adjustment is determined, the backlight brightness and image luminance adjustments may be coordinated such that they are applied in a manner to substantially take effect simultaneously such that associated visually disturbing artifacts are substantially avoided. For one embodiment, this coordination may be managed by the coordinator module 259. For other embodiments, coordination of backlight and gamma LUT table adjustments may be managed by another software or hardware component.

Figure 11:
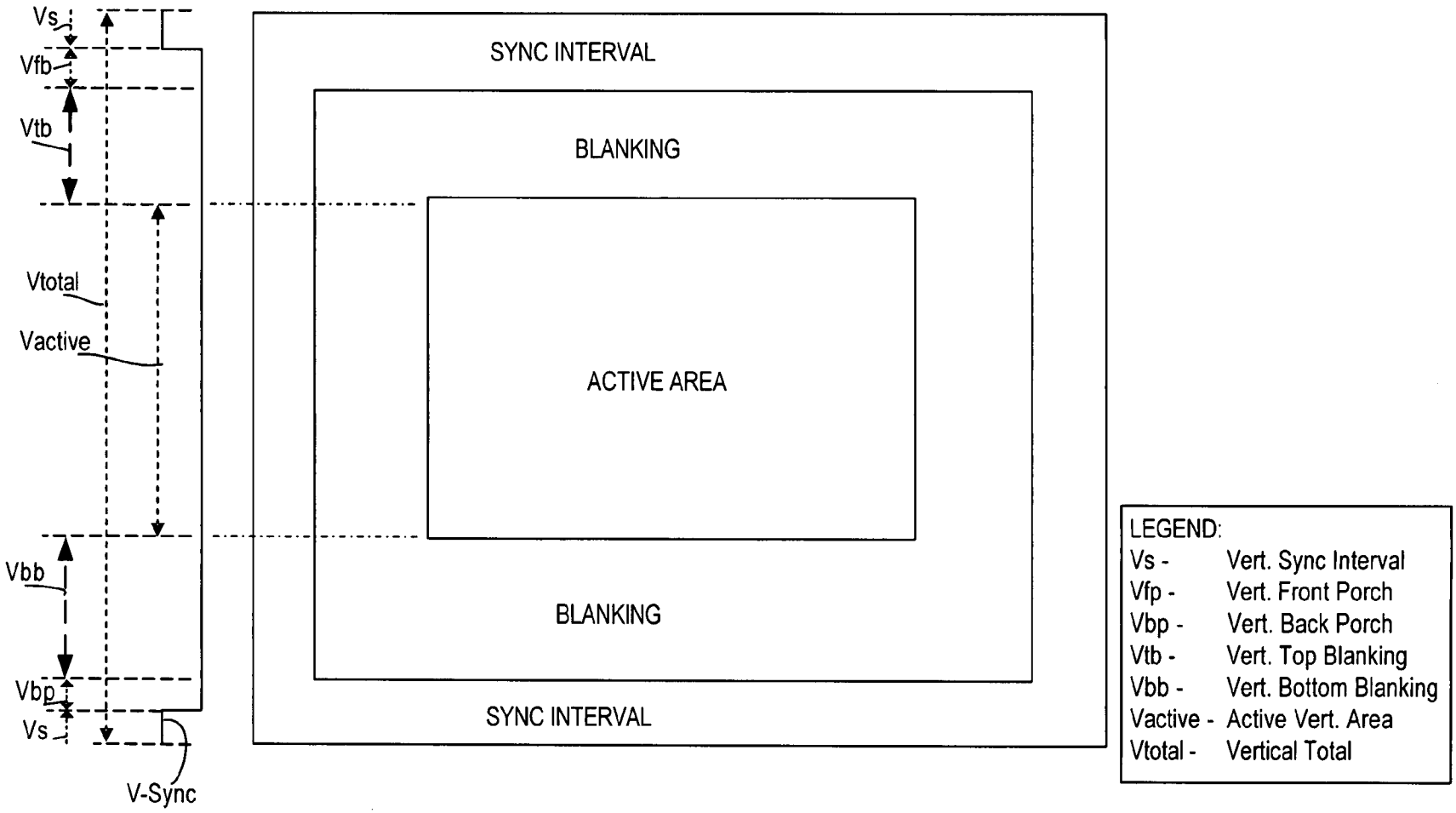
FIG. 11 is a diagram illustrating exemplary timing of vertical scanlines.

To determine when backlight and gamma LUT table adjustments (to adjust image luminance/brightness) are to be initiated, the latency Td may be compared to the interval within which the gamma changes take effect, for example, within the duration of a vertical refresh. FIG. 11 illustrates exemplary timings for vertical scanlines for purposes of illustration. It will be appreciated that other timings may apply for other embodiments.

In coordinating the backlight and image luminance adjustments, if the latency Td is less than the duration of a vertical refresh, then the gamma ramp update and backlight brightness adjustment may be safely altered at roughly the same time at a vertical line towards the end of a vertical refresh. The starting line is computed from the time of a vertical scanline (which is the total number of vertical lines divided by the refresh rate), and then the number of scanlines proportional to the latency in lines is subtracted from the line count to the beginning of the first visible scanline in the next vertical refresh (i.e. including any non-visible blanking or sync intervals). In such a case, the backlight pulse width modulation adjustment would typically still occur first to accommodate a longer latency.

If the latency Td is greater than the duration of one vertical refresh, the latency is divided by the refresh interval to derive an integer number of refreshes, and the remainder, if any, is divided by the scanline interval to derive an approximate number of scanlines. If the remainder is significant then the backlight PWM adjustment may be issued at the scanline derived using the same method described above when the latency is less than one in the current vertical refresh. The adjustment to the gamma LUT 227, however, should be postponed until the integer number of refresh-intervals beginning from the next refresh.

Figure 9:
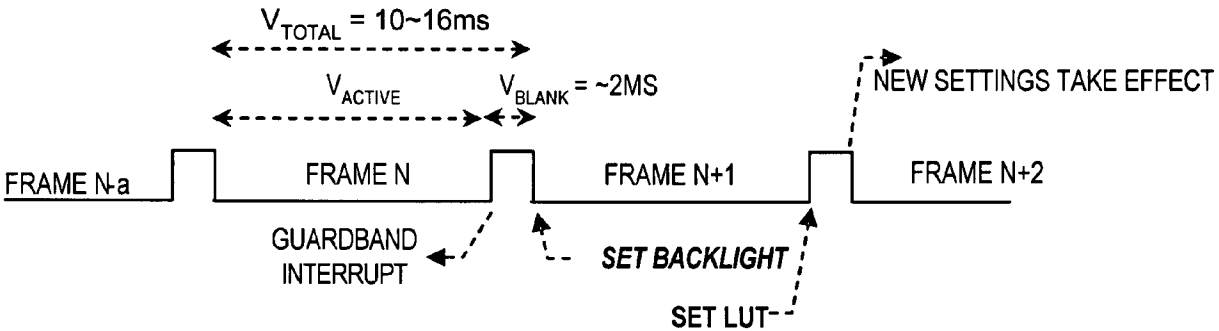
FIG. 9 is a timing diagram showing exemplary timings that may be associated with coordinating backlight brightness and image luminance adjustments for a specific refresh rate and latency value.

Coordination for other latencies may be similarly determined. Exemplary adjustment coordination timings, where the refresh rate is set at 60 Hz, are illustrated in FIG. 9. It will be appreciated that the timings may be different for different frequencies and/or latencies.

Further details of the approach for coordinating backlight and image luminance/brightness adjustments are provided in the following pseudo code.

1. Compute the latency to arrive at goal brightness based on current brightness setting
2. Divide latency into granularity of Vertical Refresh Rate units
3. Compute the new Gamma Ramp to be applied with the goal Brightness adjustment 4. If the latency is less than a vertical refresh, "S" number of scanlines
   a. Wait until the scanline=total number of vertical scanlines minus "S"
   b. Set the goal Brightness Level & Gamma
5. If the latency is around half the vertical refresh
   a. If current scan-line is less than mid-way through screen-refresh then wait until mid-point scanline in display refresh
      i. Set the goal Brightness Level
   b. Wait until vertical blanking interval
      i. Set the new Gamma Ramp
6. If the latency is around the time of one vertical refresh
   a. Wait until beginning of vertical blanking interval
      i. Set the goal Brightness Level
   b. Wait until next vertical blanking interval
      i. Set the new Gamma Ramp
7. If the latency is greater than one vertical refresh and roughly "N" refreshes
   a. Set the goal Brightness Level immediately
   b. Wait until vertical blanking interval, "N"-vertical refreshes later
      i. Set the new Gamma Ramp
8. If the latency is greater than "N" integer number of refreshes plus "S" number of scanlines
   a. Wait until the scanline=total number of vertical scanlines minus S
   b. Set the goal Brightness Level immediately
   c. Wait until vertical blanking interval, then "N"-vertical refreshes later
      i. Set the new Gamma Ramp Using the approaches of one or more embodiments for determining backlight adjustment latency and coordinating backlight brightness and image luminance adjustment it may be possible to provide a substantially consistent user-perceived image quality while enabling display power management, for example.

Figure 10:
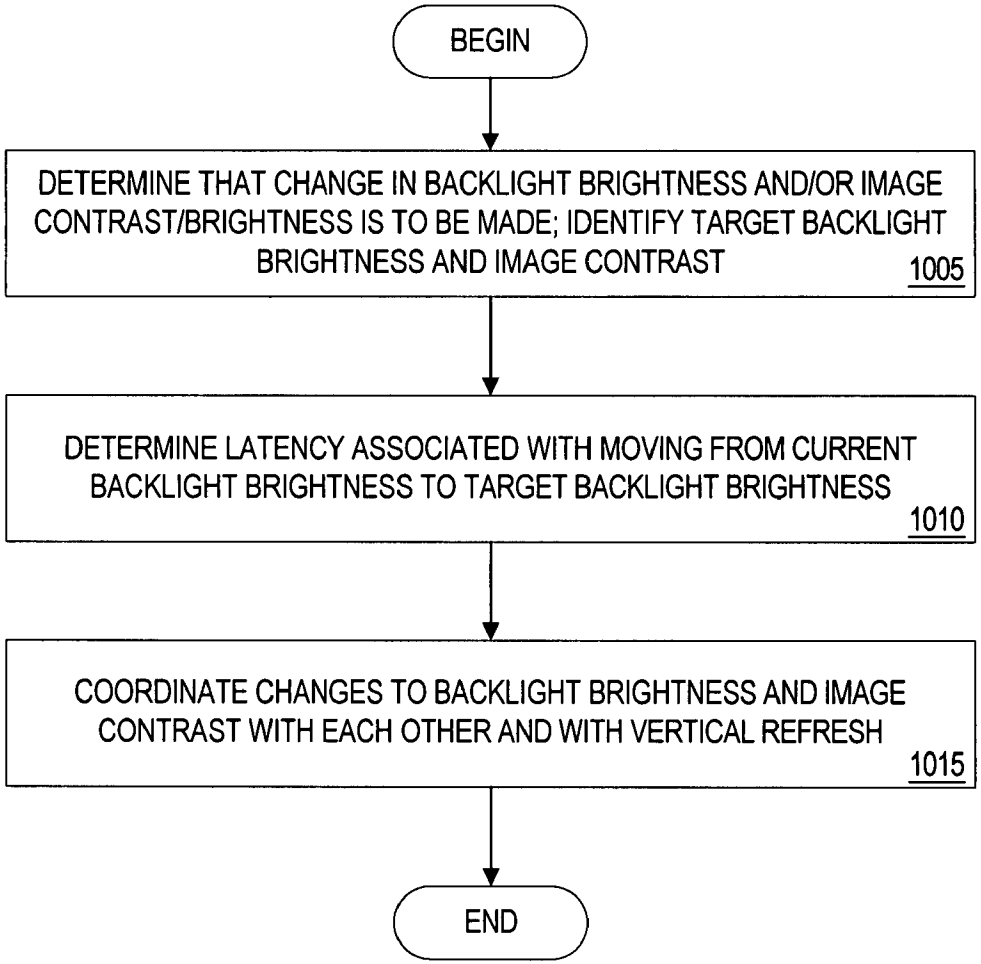
FIG. 10 is a flow diagram showing a method of one embodiment for coordinating backlight brightness and image luminance adjustments.

Referring to FIG. 10, a method of one embodiment for coordinating backlight brightness and image luminance/brightness adjustments is provided. At block 1005, it is determined that a change in backlight brightness and/or image luminance/brightness is to be made and target backlight brightness and image luminance levels are identified. At block 1010, a latency associated with moving from the current brightness setting to the target brightness setting is determined. For one embodiment, this may involve accessing characterization data and, in some cases, interpolating between known points to determine the latency.

Once the latency is determined, at block 1015, changes to the backlight brightness and image luminance/brightness are coordinated with each other and with the vertical refresh rate to provide for a substantially seamless transition from current backlight brightness and image luminance settings to target backlight brightness and image luminance settings.

Thus, various embodiments of methods and apparatuses for characterizing and/or predicting display backlight latency response and/or coordinating backlight and image luminance adjustments are described. In the foregoing specification, the invention has been described with reference to specific exemplary embodiments thereof. It will, however, be appreciated that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A method comprising:

determining a latency associated with changing a backlight brightness from a first level to a second level;

based on the determined latency, coordinating adjustments to a) the backlight brightness and b) image luminance to occur in such a manner so as to substantially avoid associated visually disturbing artifacts; and coordinating the adjustments to a) the backlight brightness and b) image luminance with at least one of a vertical refresh and a scanline interval rate, the coordinating the adjustments to a) the backlight brightness and b) image luminance with at least one of a vertical refresh and a scanline interval rate includes dividing the latency by a vertical refresh and scanline period.

2. The method of claim 1 wherein coordinating the adjustments with the vertical refresh rate includes if the latency is less than one half the vertical refresh period, initiating changing the image luminance and setting the backlight brightness at the second level prior to the beginning of a following vertical refresh;

if the latency is approximately one half of the vertical refresh period, if a current scanline is less than mid-way through a screen refresh, initiating setting the backlight brightness at the second level at a mid-point scanline of the screen refresh and initiating setting the image luminance prior to the beginning of a following vertical blanking interval;

if the latency is approximately equal to the time of one vertical period, initiating setting the backlight brightness at the second level at the beginning of a vertical blanking interval, and initiating setting the image luminance at the next vertical blanking interval; and if the latency is greater than one vertical refresh period, initiating setting the backlight brightness at the second level, and initiating setting the image luminance at the vertical blanking interval associated with the refresh period closest to the latency.

3. The method of claim 1 wherein determining the latency includes accessing first and second stored data points indicating a latency associated with changing the backlight from a third level to a fourth level, and interpolating between the first and second data points.

4. The method of claim 3 wherein accessing first and second stored data points includes accessing a video memory.

5. A method comprising:

accessing data indicating latencies associated with changing a display backlight brightness;

based on first and second data points of the data, determining a latency associated with adjusting the backlight from a first brightness level to a second brightness level; and based on the latency, coordinating the adjustment of the backlight from the first brightness level to the second brightness level with an adjustment to image luminance such that the adjustments to the backlight and image luminance occur at substantially a same time.

6. The method of claim 5 wherein determining includes interpolating between the first and second data points.

7. The method of claim 5 wherein coordinating the backlight and image luminance adjustments includes coordinating with a vertical refresh period associated with refreshing the display.

8. The method of claim 5 wherein accessing data indicating latencies includes accessing data indicating latencies determined by a method comprising:

applying an input signal to change a display backlight brightness from a first level to a target level;

sensing the backlight brightness; and logging a latency associated with changing the backlight brightness from the first level to a second level, the second level being one of the target level and an intermediate level between the first level and the target level.

9. The method of claim 8 for determining the data indicating latencies further comprising storing the logged latency in a memory of a system including the display.

10. The method of claim 8 for determining the data indicating latencies further comprising setting pixels of the display at a substantially highest transmissivity setting.

11. The method of claim 10 for determining the data indicating latencies further comprising performing the applying, sensing and logging actions with the pixels set at the highest transmissivity setting;

setting the pixels at a midrange transmissivity setting and performing the applying, sensing and logging actions a second time; and comparing latencies associated with the highest and midrange transmissivity settings.

12. The method of claim 8 for determining the data indicating latencies wherein the input signal is a substantially step input signal.

13. An apparatus comprising:

a memory to store first and second data points indicating first and second latencies associated with changing a display backlight brightness;

an interpolator to interpolate between the first and second data points to determine a third latency associated with a changing a backlight brightness from a first backlight brightness to a second backlight brightness; and a coordinator to coordinate changing the backlight brightness from the first backlight brightness to the second backlight brightness with changing an image luminance based on the third latency.

14. The apparatus of claim 13 further comprising a timing generator to control a display vertical refresh rate, the coordinator further to coordinate changes to the backlight brightness and image luminance with the vertical refresh rate.

15. The apparatus of claim 13 wherein the memory is a non-volatile memory on a system including the display.

16. An apparatus comprising:

a backlight; and pixels having a transmissivity responsive to an image luminance setting, an adjustment to a brightness of the backlight and an associated adjustment to image luminance to be coordinated to occur at substantially a same time based on a latency associated with the adjustment to the brightness of the backlight.

17. The apparatus of claim 16 wherein the backlight and pixels are part of a display, and wherein adjustments to the backlight brightness and the image luminance are further coordinated with a vertical refresh period for the display.

18. A machine-accessible medium storing information that, when accessed by a computing system, causes the computing system to:

determine a latency associated with changing a backlight brightness from a first level to a second level;

based on the determined latency, coordinate adjustments to a) the backlight brightness and b) image luminance to occur in such a manner so as to substantially avoid associated visually disturbing artifacts; and coordinate the adjustments to a) the backlight brightness and b) image luminance with a vertical refresh rate, the coordinating the adjustments to a) the backlight brightness and b) image luminance with a vertical refresh rate includes dividing the latency by a vertical refresh period.

19. The machine-accessible medium of claim 18 wherein coordinating the adjustments with the vertical refresh rate includes if the latency is less than one half the vertical refresh period, initiating changing the image luminance and setting the backlight brightness at the second level prior to the beginning of a following vertical blanking interval;

if the latency is approximately one half of the vertical refresh period, if a current scanline is less than mid-way through a screen refresh, initiating setting the backlight brightness at the second level at a mid-point of the screen refresh and initiating setting the image luminance at a vertical blanking interval;

if the latency is approximately equal to the time of one vertical period, initiating setting the backlight brightness at the second level at the beginning of a vertical blanking interval, and initiating setting the image luminance at the next vertical blanking interval; and if the latency is greater than one vertical refresh period, initiating setting the backlight brightness at the second level, and initiating setting the image luminance at the vertical blanking interval associated with the refresh period(s) closest to the latency.

20. The machine-accessible medium of claim 18 wherein determining the latency includes accessing first and second stored data points indicating a latency associated with changing the backlight from a third level to a fourth level, and interpolating between the first and second data points.

21. The machine-accessible medium of claim 20 wherein accessing first and second stored data points includes accessing a video memory.

* * * * *